US012092118B2

(12) United States Patent
Maier

(10) Patent No.: US 12,092,118 B2
(45) Date of Patent: Sep. 17, 2024

(54) MULTI-STAGE COMPRESSOR ASSEMBLY HAVING ROWS OF BLADES ARRANGED TO ROTATE IN COUNTER-OPPOSITE ROTATIONAL DIRECTIONS

(71) Applicant: SIEMENS ENERGY GLOBAL GMBH & CO. KG, Munich (DE)

(72) Inventor: William C. Maier, Almond, NY (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 18/272,927

(22) PCT Filed: Feb. 3, 2022

(86) PCT No.: PCT/US2022/015082

§ 371 (c)(1),
(2) Date: Jul. 18, 2023

(87) PCT Pub. No.: WO2022/169951

PCT Pub. Date: Aug. 11, 2022

(65) Prior Publication Data

US 2024/0035480 A1 Feb. 1, 2024

Related U.S. Application Data

(60) Provisional application No. 63/146,231, filed on Feb. 5, 2021.

(51) Int. Cl.
*F04D 19/02* (2006.01)
*F04D 25/16* (2006.01)

(52) U.S. Cl.
CPC ..... *F04D 19/024* (2013.01); *F04D 25/16* (2013.01)

(58) Field of Classification Search
CPC ..... F04D 19/024; F04D 17/12; F04D 25/16; F04D 25/163
See application file for complete search history.

(56) References Cited

U.S. PATENT DOCUMENTS 750,316 A 1/1904 Stumpf
1,944,537 A * 1/1934 Wiberg ..... F01D 1/28 415/64

(Continued)

FOREIGN PATENT DOCUMENTS

CN 101813094 A 8/2010
CN 105378290 A 3/2016

(Continued)

OTHER PUBLICATIONS

PCT International Search Report and Written Opinion of the International Searching Authority dated May 10, 2022 corresponding to PCT Application No. PCT/US2022/015082 filed Feb. 3, 2022.

(Continued)

*Primary Examiner* — J. Todd Newton
*Assistant Examiner* — Jackson N Gillenwaters
(74) *Attorney, Agent, or Firm* — Enrique J. Mora

(57) ABSTRACT

A multi-stage compressor assembly is disclosed. Each of the stages of the compressor assembly has rows of blades arranged to rotate in counter-opposite directions, and this is effective to produce relatively high specific work, and high flow-capacity in a compact footprint at moderate blade tip speeds. In one non-limiting application, the compressor assembly can be utilized to compress a gas having a low-molecular weight and density, such as hydrogen.

21 Claims, 7 Drawing Sheets

(56) References Cited

U.S. PATENT DOCUMENTS

| | | | | |
|---|---|---|---|---|
| 2,361,726 | A * | 10/1944 | Weimar | F04D 17/127 415/87 |
| 3,314,647 | A * | 4/1967 | Pavlecka | F01D 1/28 415/64 |
| 5,417,544 | A | 5/1995 | Mohn | |
| 6,264,910 | B1 | 7/2001 | Maurer et al. | |
| 9,127,595 | B2 | 9/2015 | Maier | |
| 9,745,860 | B1 | 8/2017 | Haskin | |
| 10,526,964 | B2 | 1/2020 | Becker et al. | |
| 2010/0158665 | A1 | 6/2010 | Hofer et al. | |
| 2012/0100015 | A1 | 4/2012 | Kim et al. | |
| 2016/0230771 | A1 | 8/2016 | Dobat et al. | |
| 2016/0333886 | A1 | 11/2016 | Andersen | |
| 2020/0271211 | A1 | 8/2020 | Oohama | |
| 2021/0102546 | A1 | 4/2021 | Brun et al. | |

FOREIGN PATENT DOCUMENTS

| | | | |
|---|---|---|---|
| CN | 105927283 | A | 9/2016 |
| DE | 4239138 | A1 | 5/1994 |
| DE | 102017124689 | A1 | 5/2018 |
| DE | 102019123687 | A1 * | 3/2021 |
| GB | 202295 | A | 6/1924 |
| GB | 773499 | A | 4/1957 |
| JP | H11314907 | A | 11/1999 |
| JP | 2004232601 | A | 8/2004 |
| JP | 2016145636 | A | 8/2016 |
| JP | 6137983 | B2 | 5/2017 |
| JP | 2020133556 | A | 8/2020 |
| KR | 20120042481 | A | 5/2012 |
| KR | 20210041484 | A | 4/2021 |

OTHER PUBLICATIONS

Ljungström turbine, from Wikipedia, The Free Encyclopedia, retrieved from https://en.wikipedia.org/w/index.php?title=Ljungström_turbine&oldid=1132936504.

Dejour et al. "Assessment of a Novel Non-Axial Counter-Rotating Compressor Concept for Aero-Engines", retrieved from Proceedings of ASME Turbo Expo 2018 Turbomachinery Technical Conference and Exposition, Oslo, Norway, Jun. 2018.

Beaty et al., Integrally Geared API 617 Process Gas Compressors.

Kim et al., "Multiobjective Optimization of a Counterrotating Type Pump-Turbine Unit Operated at Turbine Mode", Hindawi Publishing Corporation, vol. 2014, Article ID 467235, 11 pages, available at http://dx.doi.org/10.1155/2014/467235.

TMI Staff & Contributors, What the Subsea Compression Projects in Norway Tell Us, Sep. 2019.

Zaryankin et al., "The applicability of two-tier low pressure turbine in high-power condensing steam turbines", AIP Conference Proceedings available at https://doi org/10.1063/1.5081647, Published by the American Institute of Physics, Nov. 2018.

* cited by examiner

MULTI-STAGE COMPRESSOR ASSEMBLY HAVING ROWS OF BLADES ARRANGED TO ROTATE IN COUNTER-OPPOSITE ROTATIONAL DIRECTIONS

STATEMENT OF GOVERNMENT INTEREST

This invention was made with government support under DE-FE0032033 awarded by the US Department of Energy. The government has certain rights in the invention.

BACKGROUND

The present disclosure relates to compression of a fluid, and, more specifically, relates to a multi-stage compressor assembly having rows of blades arranged to rotate in counter-opposite rotational directions, and, even more specifically, relates to a compressor assembly that, in one non-limiting application, can be utilized to efficiently compress a gas having a low-molecular weight and density, such as hydrogen.

Many countries and industries currently see hydrogen as one important element for sustainable energy infrastructures of the future. The growth and establishment of a hydrogen-sustainable economy will require solving technical challenges involved with current compression capabilities for hydrogen gas.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
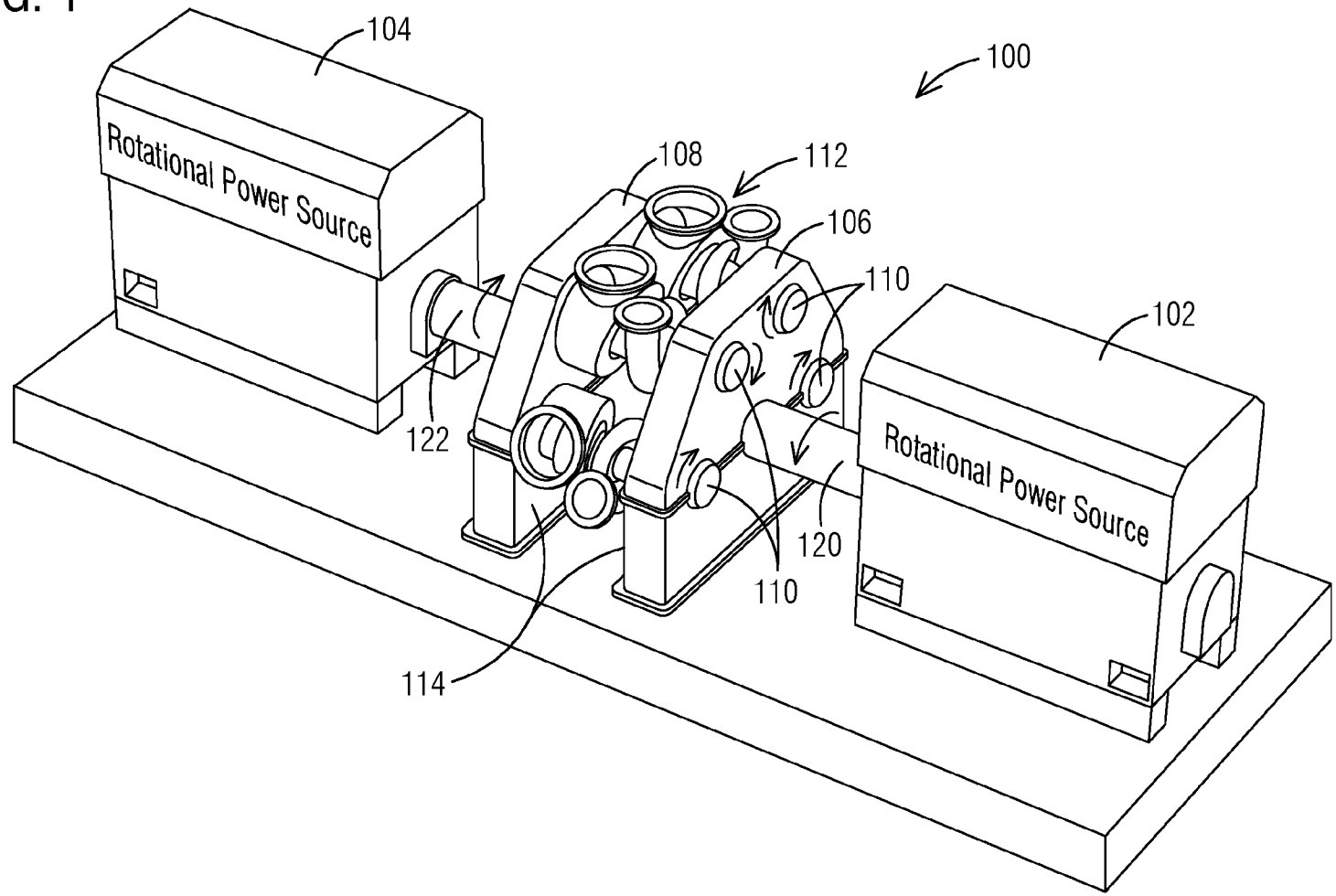
FIG. 1 is an isometric view of one example embodiment of a disclosed compressor assembly that involves dual rotational power sources each driving a respective gear box having multiple pinions, which in turn drive multiple compression stages of the compressor assembly, disposed, for example, on a respective face of the gear boxes.

Before any disclosed embodiments are explained in detail, it is to be understood that disclosed concepts are not limited in their application to the details of construction and the arrangement of components set forth in this description or illustrated in the following drawings. Disclosed concepts are capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

It should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean that an element is relatively near to but not in contact with a further element or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

The present inventor has recognized a need in various industrial sectors of compressors capable of producing a relatively high specific work. That is, compressors that in a cost-effective manner and with a compact footprint efficiently improve the specific work exchanged between rotating shafts and a process fluid, per unit mass of the process fluid being processed. One non-limiting application is compressing a gas having a low-molecular weight and density, such as hydrogen or hydrogen-rich fluid mixtures, for use or distribution in a low-carbon energy economy. Disclosed embodiments utilize double rows of rotatable blades arranged to rotate in counter-opposite rotational directions to provide greater specific work per stage subject to the structural limitations of the blade materials involved. That is, disclosed embodiments are conducive to provide relatively high-pressure ratio and high flow-capacity at moderate blade tip speeds and thus without having to utilize relatively costlier metals or metal alloys that otherwise would be required to withstand high blade tip speeds. By way of example, pressure ratios in a range from 1.1 to 1.5 can be realized in respective compression stages of disclosed embodiments compared to known multi-stage centrifugal compressor that typically produce pressure ratios below 1.05 in applications involving a low molecular weight gas. It is expected that disclosed embodiments can readily be applied in applications involving volume flows in a range from 8 m^3/s to 30 m^3/s. By way of example, the 1.5 pressure ratio may be produced in disclosed embodiments with a blade tip speed of no more than 370 m/s.

FIG. 1 is an isometric view of one example embodiment of a disclosed compressor assembly 100, where a rotational power source comprises separate, dual rotational power sources 102, 104, such as may involve respective electric motors or respective turbomachines. In this example, each power source is connected to drive a respective gear box 106, 108. Each gear box has multiple pinions 110 (e.g., pinion gears), which in turn drive rotatable blades in multiple compression stages 112 of compressor assembly 100. To reduce cumbersome visual cluttering in FIG. 1, interconnecting piping between the compression stages is not shown. It is further noted that the specific number of pinions (e.g., four) shown in FIG. 1 and the associated number of compression stages should be construed as an example and not as a limitation since this number may be adjusted based on the needs of a given application.

Figure 2:
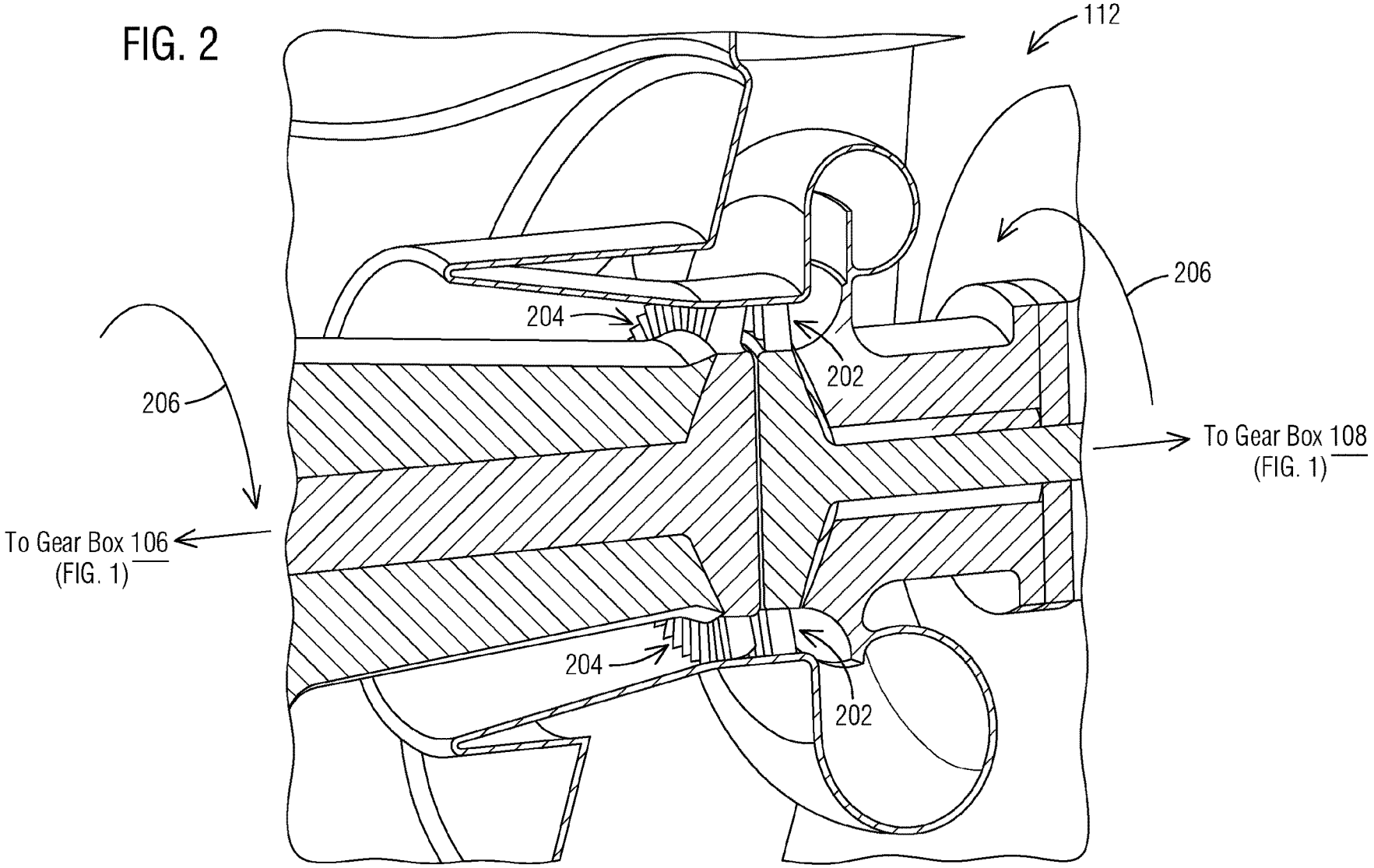
FIG. 2 is a sectional, isometric view that fragmentarily shows one embodiment of a first row of rotatable blades and a second row of rotatable blades in a respective compression stage of the multiple compression stages of the compressor assembly, where each of the rows of blades is arranged to rotate in counter-opposite rotational directions relative to one another.

Example ranges of compression stages that may be implemented in practical embodiments may be from four compression stages to sixteen compression stages or may be from four compression stages to eight compression stages. As may be appreciated in FIG. 1, by way of example, compression stages 112 may be disposed on mutually facing sides (faces) 114 of gear boxes 106, 108. The description below proceeds to describe, in the context of FIG. 2, one example of a blade arrangement that may be used in respective compression stages 112 of disclosed embodiments FIG. 2 is a sectional, isometric view that fragmentarily shows one example of a first row of rotatable blades 202 and a second row of rotatable blades 204 in a respective compression stage of the multiple compression stages 112 of the compressor assembly. Each of the rows of blades 202, 204 is arranged to rotate in counter-opposite rotational directions relative to one another, as schematically indicated by arrows 206. The respective rows of blades are designed to alter the angular momentum of a flow of a process fluid passing through the respective rows of blades. It will be appreciated that, in a general case, the rows of blades may be arranged to provide axial flow, radial flow, or a mixed flow defining a meridional flow.

The blade rows may be followed by a stationary diffuser arrangement to facilitate the conversion of inputted kinetic energy into process flow internal energy. By way of example, the rows of blades may comprise low reaction blades to boost blade efficiency. The description below proceeds to describe, in the context of FIG. 3, one example of a gear arrangement that may be used in gear boxes 106, 108 of disclosed embodiments.

Figure 3:
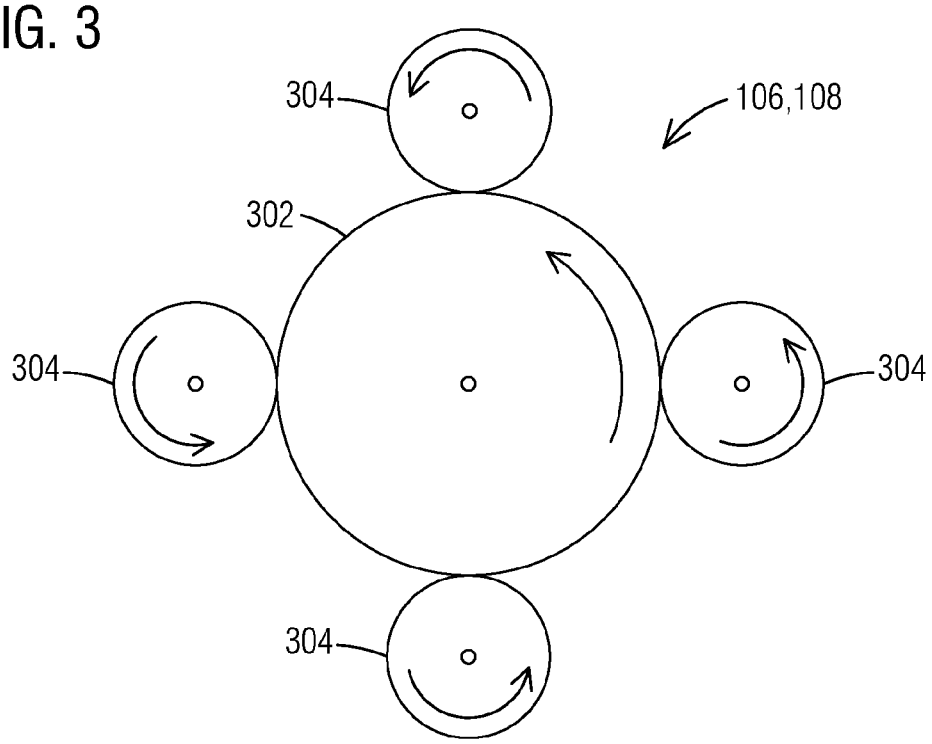
FIG. 3 is a schematic showing conceptual details of one example embodiment of a gear box that in combination with another such gear box may be used to drive the multiple compression stages in the compressor assembly.

FIG. 3 is a schematic showing conceptual details of one example of a respective gear box of gear boxes 106, 108 that in combination may be used to drive the rotatable blades in respective compression stages, such as in the embodiment involving dual rotational power sources 102, 104, as discussed above in the context of FIG. 1. In this example, a bull gear 302 receives rotational power from one of the rotational power sources 102, 104, and in turn bull gear 302 provides rotational power to pinions 304 (four, in this example) to provide rotational power to drive the respective rows of blades in the respective compression stages 112.

For example, first gear box 106 (FIG. 1) may be arranged to rotatively couple the first row of rotatable blades 202 (FIG. 2) of the first compression stage to the first row of rotatable blades 202 of the second compression stage and to additional respective first rows of rotatable blades of additional compression stages that may be part of a given implementation of a disclosed compressor assembly. In this example, involving four compression stages, this would mean the respective first rows of rotatable blades of the third and the fourth compression stages. Similarly, second gear box 108 (FIG. 1) may be arranged to rotatively couple the second row of rotatable blades 204 (FIG. 2) of the first compression stage to the second row of rotatable blades 204 of the second compression stage and to additional respective second rows of rotatable blades of additional compression stages that may be part of the given implementation of the compressor assembly. In this example, involving four compression stages, this would mean the respective second rows of rotatable blades of the third and fourth compression stages.

In one example embodiment, a shaft assembly may be arranged to couple the rotational power source to apply rotational power to at least one of the first gear box and the second gear box. As may be appreciated in FIG. 1, in one example embodiment the shaft assembly may have a first rotor shaft 120 rotating in a first rotational direction to couple the first rotational power source 102 to the first gear box 106 and may further have a second rotor shaft 122 rotating in a second rotational direction opposite to the first rotational direction to couple the second rotational power source 104 to the second gear box 108. More specifically, in this example, first rotor shaft 120 would be connected to the respective bull gear 302 (FIG. 3) in the first gear box 106 and second rotor shaft 122 would be connected to the respective bull gear 302 in the second gear box 108.

Figure 4:
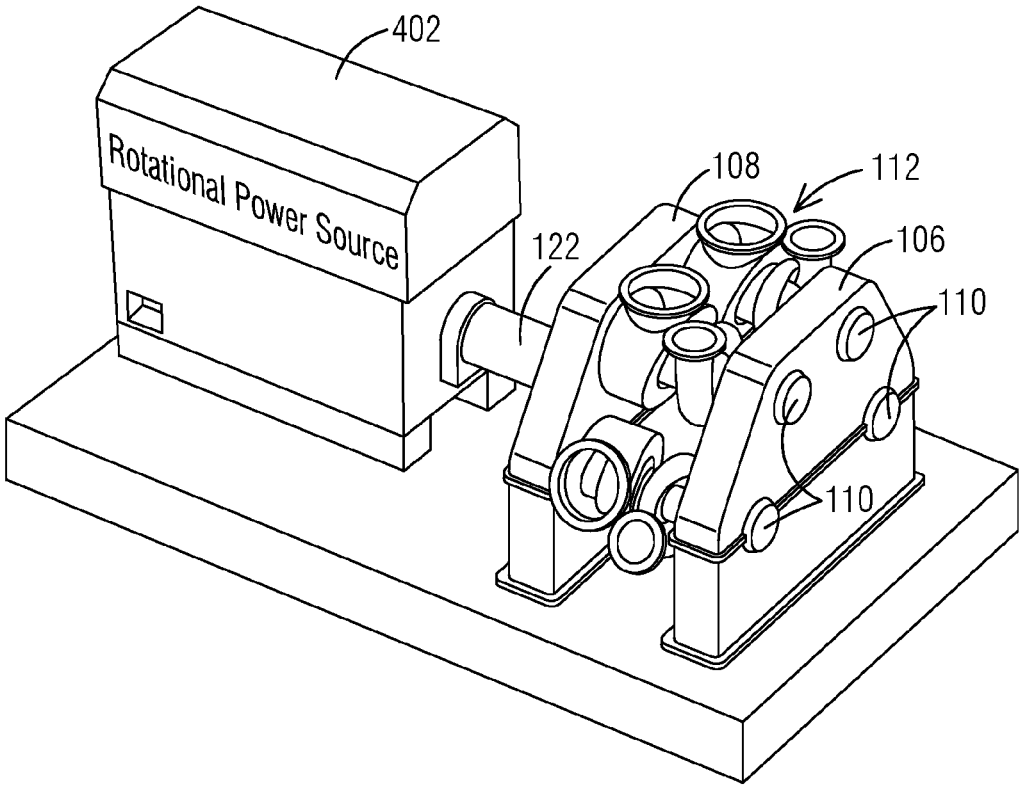
FIG. 4 is an isometric view of another embodiment of a disclosed compressor assembly that involves a singular rotational power source.
Figure 5:
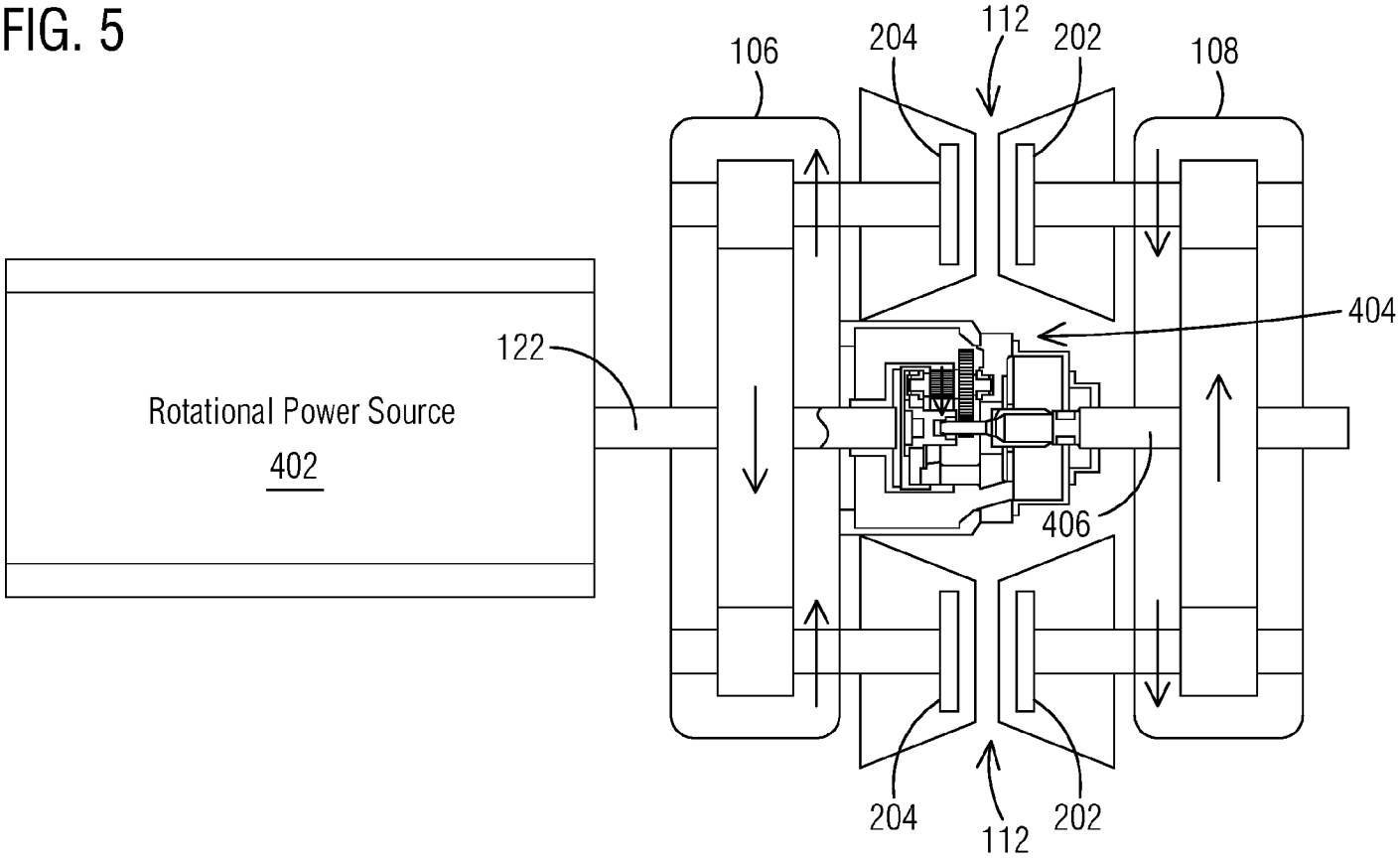
FIG. 5 is a schematic showing conceptual details of another example embodiment involving gear boxes connected with a rotation reverser gear as may be used in the compressor assembly involving the singular rotational power source.

FIG. 4 is an isometric view of another example of a disclosed compressor assembly where a singular rotational power source 402, such as may involve a respective electric motor or a respective turbomachine, is coupled to a respective one of gear boxes 106, 108, which in the figure is gear box 108. In this example, the shaft assembly includes a first rotor shaft 122 to couple the singular rotational power source 402 to provide rotational power to gear box 108 about a first rotational direction. As shown in FIG. 5, in one example embodiment, a rotation reverser gear 404 is connected between gear box 106 and gear box 108, and a second rotor shaft 406 may be used to transmit rotational power from rotation reverser gear 404 to gear box 108 about a second rotational direction, which is counter opposite to the first rotational direction so that each of the rows of blades 202, 204 rotates in counter-opposite rotational directions in the respective compressions stages 112 of the compressor assembly (for the sake of simplicity of illustration just two compression stages are shown in FIG. 5).

Figure 6:
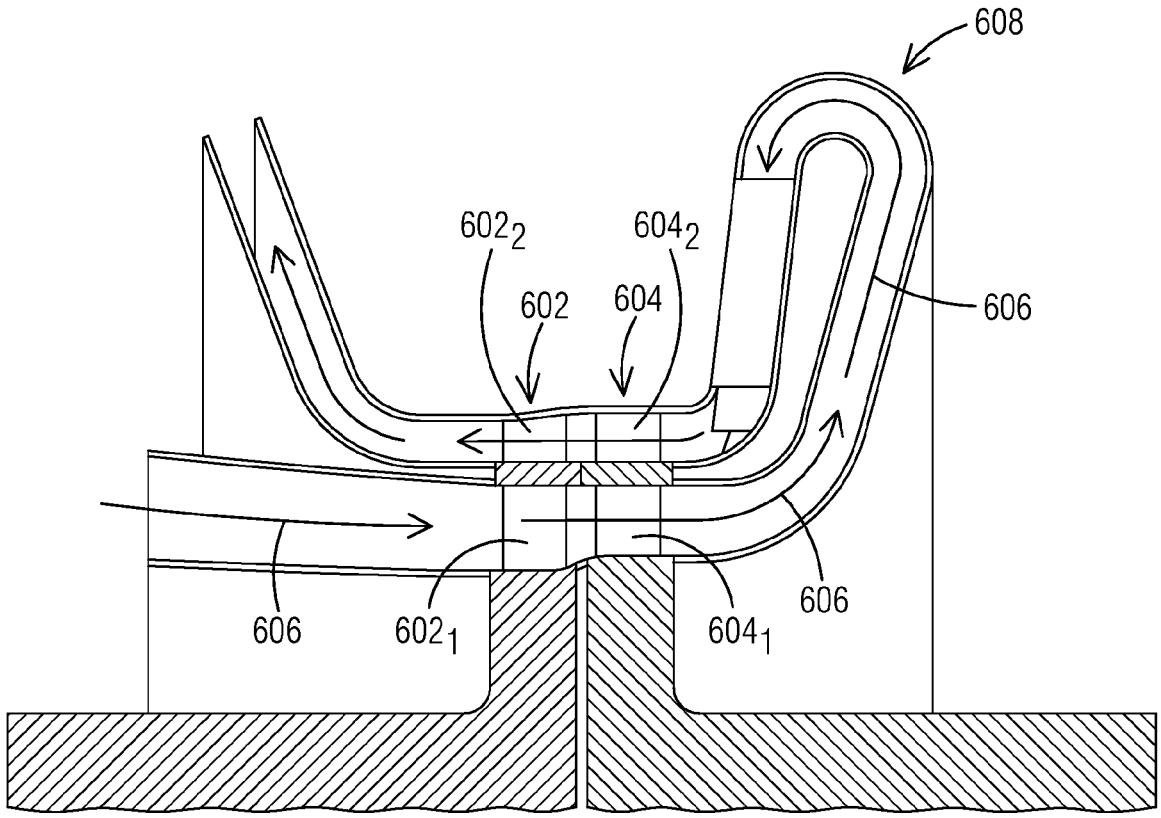
FIG. 6 is a sectional view that fragmentarily shows a first row of rotatable blades and a second row of rotatable blades arranged to rotate in counter-opposite rotational directions, where each of the rows of rotatable blades has respective radially-stacked row segments, and further shows an example flow path of a process fluid that flows about the radially-stacked row segments.

FIG. 6 is a sectional view of another example of a blade arrangement that may be used in respective compression stages of disclosed embodiments. FIG. 6 fragmentarily shows a first row of rotatable blades 602 and a second row of rotatable blades 604, where each row of rotatable blades 602, 604 is arranged to rotate in counter-opposite rotational directions. In this example, the first row of rotatable blades 602 has respective radially-stacked row segments $\mathbf{602}_1$, $\mathbf{602}_2$. That is, in the first row of rotatable blades 602, row segment $\mathbf{602}_1$ constitutes a radially-inward row segment and row segment $\mathbf{602}_2$ constitutes a radially-outward row segment. Similarly, in the second row of rotatable blades 604, row segment $\mathbf{604}_1$ constitutes a radially-inward row segment and row segment $\mathbf{604}_2$ constitutes a radially-outward row segment. This stacking arrangement is effective to increase the pressure ratio (approximately double) that may be produced in a given compression stage compared to an equivalent compression stage without the stacking arrangement of row blade segments.

FIG. 6 further shows an example flow path (schematically represented by arrows 606) of process fluid that flows through the respective radially-stacked row segments, where it can be appreciated that the radially-inward row segment $\mathbf{602}_1$ of the first row of rotatable blades 602 is fluidly coupled to the radially-inward row segment $\mathbf{604}_1$ of the second row of rotatable blades 604. In this example, the radially-inward row segments $\mathbf{602}_1$, $\mathbf{604}_1$ function as an inlet relative to process fluid being worked on by the rows of rotatable blades 602, 604 in a respective compression stage.

One can further appreciate in FIG. 6 that the radially-outward row segment $\mathbf{604}_2$ of the second row of rotatable blades 604 is fluidly coupled to the radially-outward row segment $\mathbf{602}_2$ of the first row of rotatable blades 602. A diffuser 608 is arranged to fluidly couple the radially-inward row segments $\mathbf{602}_1$, $\mathbf{604}_1$ to the radially-outward row segments $\mathbf{602}_2$, $\mathbf{604}_2$. In this case, the radially-outward row segments $\mathbf{602}_2$, $\mathbf{604}_2$ function as an outlet to the process fluid being worked on by the rows of rotatable blades 602, 604.

Figure 7:
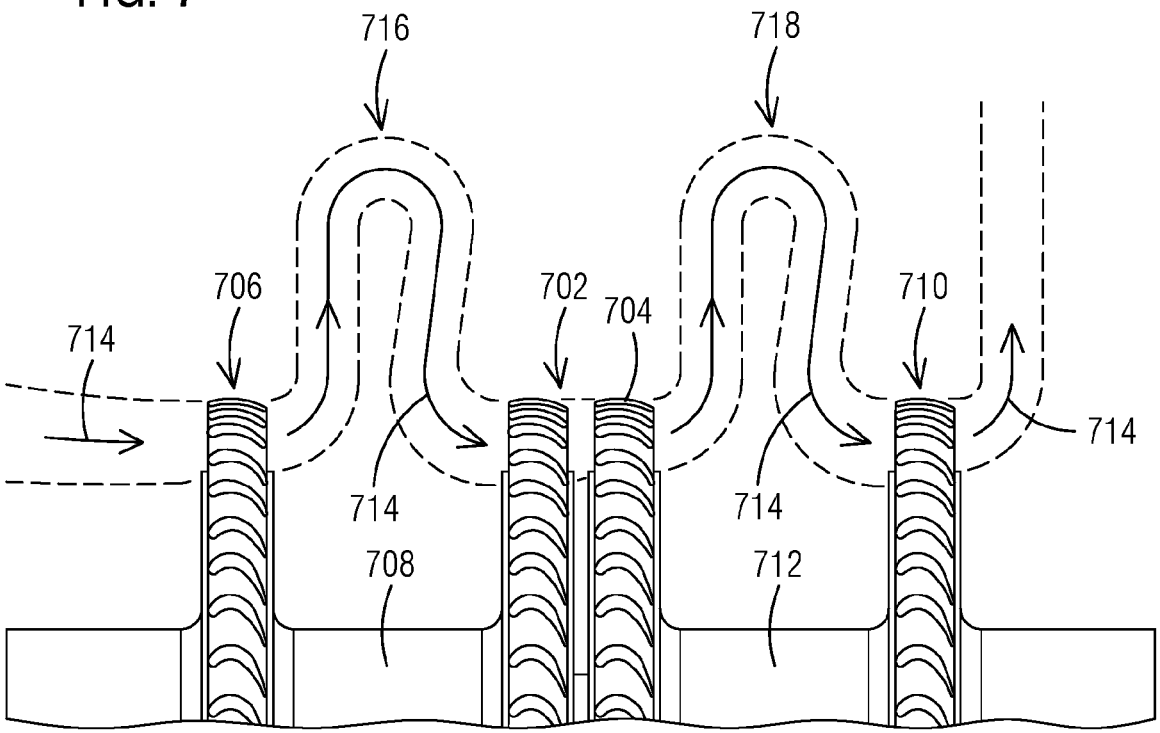
FIG. 7 fragmentarily shows a first row of rotatable blades and a second row of rotatable blades arranged to rotate in counter-opposite rotational directions on respective first and second shafts, where the first row of rotatable blades is disposed downstream from a further row of rotatable blades and is each mounted on the first shaft, and where the second row of rotatable blades is disposed upstream relative to an additional row of rotatable blades and is each mounted on the second shaft.

FIG. 7 is a schematic of yet another example of a blade arrangement that may be used in respective compression stages of disclosed embodiments. FIG. 7 fragmentarily shows a first row of rotatable blades 702 and a second row of rotatable blades 704, where each row of rotatable blades 702, 704 is arranged to rotate in counter-opposite rotational directions. FIG. 7 further shows a third row of rotatable blades 706 mounted on a common first shaft 708 with the first row of rotatable blades 702. An example flow path (schematically represented by arrows 714) of process fluid that flows through the respective rows of rotatable blades is shown in FIG. 7. As shown in FIG. 7, third row of rotatable blades 706 is disposed upstream relative to the first row of rotatable blades 702.

FIG. 7 shows a fourth row of rotatable blades 710 mounted on a second shaft 712 shared in common with the second row of rotatable blades 704 and disposed downstream relative to the second row of rotatable blades 704. This arrangement of respective extra rows of rotatable blades cooperating with the counter rotating blades 702, 704 is effective to increase the pressure ratio that may be produced in a given compression stage compared to an equivalent compression stage without the respective extra rows of rotatable blades. A first diffuser 716 is arranged to fluidly couple the third row of rotatable blades 706 with the first row of rotatable blades 702. A second diffuser 718 is arranged to fluidly couple the second row of rotatable blades 704 with the fourth row of rotatable blades 710.

Figure 8:
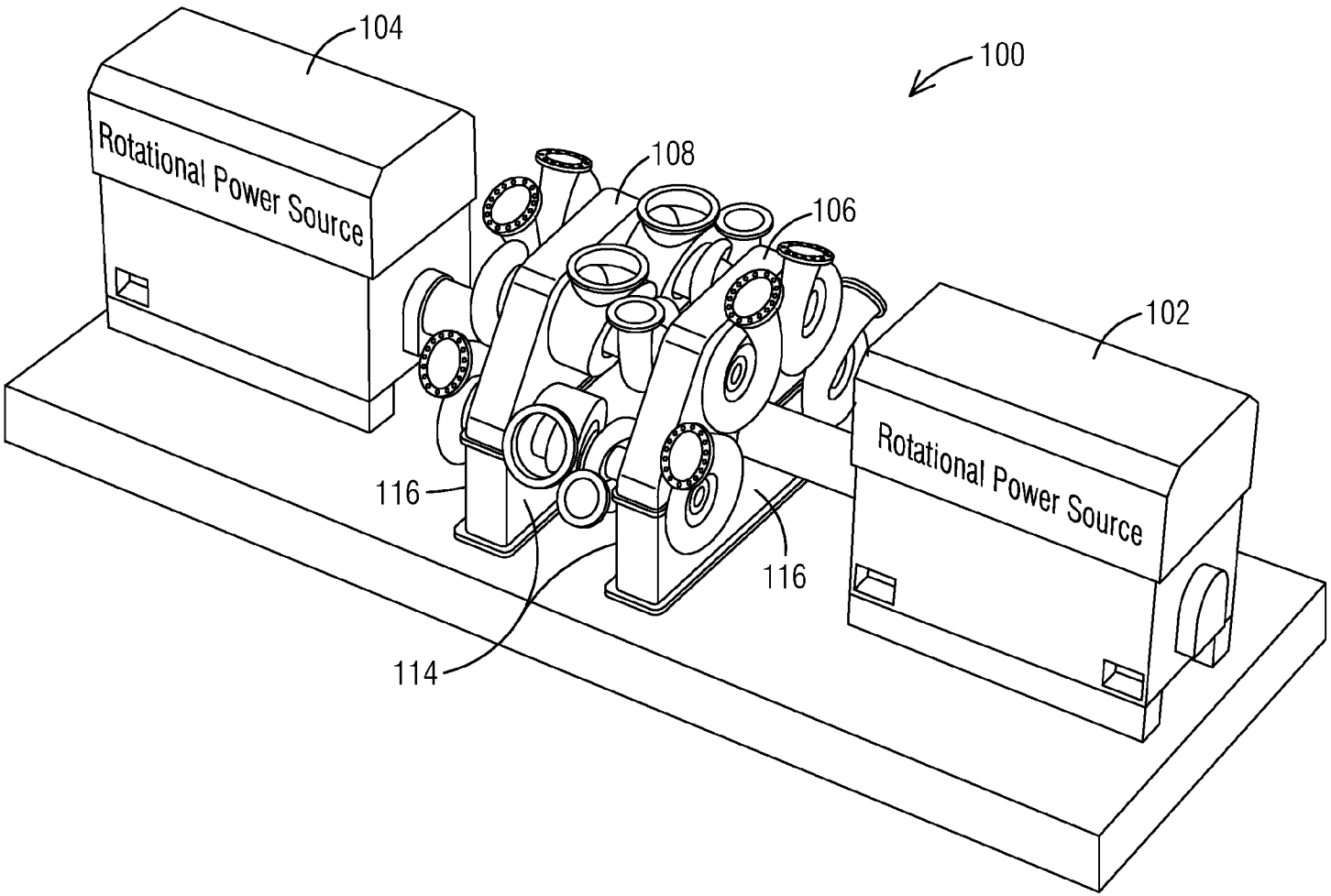
FIG. 8 is an isometric view of still another embodiment of a disclosed compressor assembly that involves respective additional rows of rotatable blades disposed, for example, on respective opposite faces of the respective gear boxes.

FIG. 8 is an isometric view of still another embodiment of a disclosed compressor assembly that involves respective additional rows of rotatable blades disposed, for example, on respective opposite faces 116 of the respective gear boxes 108, 106. This arrangement is conceptually equivalent to the blade arrangement involving extra rows of rotatable blades discussed above in the context of FIG. 7. That is, respective row of rotatable blades arranged to rotate in counter-opposite rotational directions are disposed on the mutually facing sides 114 of gear boxes 106, 108 (as discussed in the context of FIG. 1) and the extra-rows of rotatable blades in this example would be arranged on the respective opposite faces 116 of gear boxes 106 and 108.

In operation, disclosed embodiments are effective to provide relatively high specific work, high flow-capacity hydrogen compression, or any other gas having a low molecular weight or low density. As those skilled in the art would now appreciate, disclosed embodiments are effective for applications that, without limitation, could involve hydrogen distribution systems in a hydrogen-sustainable economy and provide a cost-effective, efficient replacement of known compression modalities that lack such capabilities, such as positive displacement modalities that tend to have substantial flow capacity limitations or centrifugal-compression modalities that tend to have substantial pressure ratio limitations.

Although an exemplary embodiment of the present disclosure has been described in detail, those skilled in the art will understand that various changes, substitutions, variations, and improvements disclosed herein may be made without departing from the scope of the disclosure in its broadest form.

None of the description in the present application should be read as implying that any particular element, step, act, or function is an essential element, which must be included in the claim scope. The scope of patented subject matter is defined only by the allowed claims. Moreover, none of these claims are intended to invoke a means plus function claim construction unless the exact words "means for" are followed by a participle.

What is claimed is:

1. A compressor assembly comprising:

a first compression stage comprising a first row of rotatable blades and a second row of rotatable blades;

a second compression stage comprising a first row of rotatable blades and a second row of rotatable blades;

a first gear box connected to rotatively couple the first row of rotatable blades of the first compression stage to the first row of rotatable blades of the second compression stage;

a second gear box connected to rotatively couple the second row of rotatable blades of the first compression stage to the second row of rotatable blades of the second compression stage;

a rotational power source;

a shaft assembly arranged to couple the rotational power source to apply rotational power to at least one of the first gear box and the second gear box, wherein the first row of rotatable blades of the first compression stage and the first row of rotatable blades of the second compression stage are arranged to rotate in a first direction, and wherein the second row of blades of the first compression stage and the second row of blades of the second compression stage are arranged to rotate in a second direction opposite to the first direction.

2. The compressor assembly of claim 1, wherein the rotational power source comprises a first rotational power source and a second rotational power source.

3. The compressor assembly of claim 2, wherein the shaft assembly comprises a first rotor shaft to couple the first rotational power source to the first gear box, and wherein the shaft assembly further comprises a second rotor shaft to couple the second rotational power source to the second gear box.

4. The compressor assembly of claim 1, wherein the rotational power source comprises a singular rotational power source coupled to a respective one of the gear boxes.

5. The compressor assembly of claim 4, wherein the shaft assembly comprises a first rotor shaft to couple the singular rotational power source to the respective one of the gear boxes.

6. The compressor assembly of claim 5, further comprising a rotation reverser gear connected between the respective one of the gear boxes, and the other one of the gear boxes.

7. The compressor assembly of claim 6, wherein the shaft assembly comprises a second rotor shaft to couple the rotation reverser gear to the other one of the gear boxes.

8. The compressor assembly of claim 1, wherein the first row of rotatable blades of the first compression stage is formed by a radially-inward row segment and a radially-outward row segment, and the second row of rotatable blades of the first compression stage comprises a radially-inward segment and a radially-outward segment, wherein the radially-inward row segment of the first row of rotatable blades is fluidly coupled to the radially-inward row segment of the second row of rotatable blades, and the radially-inward row segments function as an inlet in the first compression stage.

9. The compressor assembly of claim 8, wherein the radially-outward row segment of the first row of rotatable blades is fluidly coupled to the radially-outward row segment of the second row of rotatable blades, and the radially-outward row segments function as an outlet in the first compression stage.

10. The compressor assembly of claim 8, further comprising a diffuser arranged to fluidly couple the radially-inward row segments to the radially-outward row segments.

11. The compressor assembly of claim 1, wherein the first compression stage further comprises a third row of rotatable blades mounted on a common shaft with the first row of rotatable blades of the first compression stage and disposed upstream relative to the first row of rotatable blades of the first compression stage.

12. The compressor assembly of claim 11, wherein the first compression stage comprises a fourth row of rotatable blades mounted on a common shaft with the second row of rotatable blades of the first compression stage and disposed downstream relative to the second row of rotatable blades of the first compression stage.

13. The compressor assembly of claim 12, further comprising a first diffuser arranged to fluidly couple the third row of rotatable blades with the first row of rotatable blades of the first compression stage.

14. The compressor assembly of claim 13, further comprising a second diffuser arranged to fluidly couple the fourth row of rotatable blades with the second row of rotatable blades of the first compression stage.

15. The compressor assembly of claim 1, wherein each of the blades in the first row of rotatable blades and in the second row of rotatable blades of each of the compression stages has a low-reaction profile.

16. The compressor assembly of claim 1, wherein a process fluid processed by the compressor assembly is one of a hydrogen fluid and a hydrogen-rich fluid mixture.

17. The compressor assembly of claim 16, having between four to sixteen compression stages.

18. The compressor assembly of claim 17, having between four to eight compression stages.

19. The compressor assembly of claim 16, having a volume flow of the process fluid in a range from 8 m^3/s to 30 m^3/s.

20. The compressor assembly of claim 16, wherein a respective compression stage of the first and the second compression stages has a pressure ratio in a range from 1.1 to 1.5.

21. The compressor assembly of claim 20, wherein blade tip speed of the first and the second row of rotatable blades is no more than 370 m/sec at the pressure ratio of 1.5.

* * * * *